United States Patent [19]

Ban

[11] Patent Number: 4,533,044

[45] Date of Patent: Aug. 6, 1985

[54] STORAGE CONTAINER FOR PAINT APPLICATORS

[76] Inventor: Thomas E. Ban, 1156 Berwick La., South Euclid, Ohio 44121

[21] Appl. No.: 632,382

[22] Filed: Jul. 19, 1984

[51] Int. Cl.[3] ..... A45D 44/18; B65D 81/24

[52] U.S. Cl. ..... 206/362; 206/15.2; 206/15.3

[58] Field of Search ..... 206/361, 362, 15.2, 206/15.3, 63.5

[56] References Cited

U.S. PATENT DOCUMENTS

| | | | |
|---|---|---|---|
| 851,443 | 4/1907 | Schmidt | 206/15.3 |
| 1,128,984 | 2/1915 | Holtzman | 206/361 |
| 3,262,556 | 2/1966 | Morrison | 206/15.3 |
| 3,291,295 | 12/1966 | Caligiuri | 206/15.3 |
| 3,905,476 | 9/1975 | Foreman | 206/361 |
| 3,955,670 | 5/1976 | Buslik | 206/15.3 |
| 4,190,153 | 2/1980 | Olsen | 206/362 |

*Primary Examiner*—Joseph Man-Fu Moy
*Attorney, Agent, or Firm*—Harlan E. Hummer

[57] ABSTRACT

A device is described for holding a paint brush or roller in wet storage in the sealed chamber of a container. The chamber is designed to hold a paint dissolving solvent which creates an atmosphere in which a paint ladened brush or roller remains soft and pliable until it can be thoroughly cleaned, or until it is reused. The device includes an open top container which is provided with a cover for sealing the chamber, within the container, from the ambient atmosphere. The cover, in turn, is provided with a relatively small opening from which a number of slits, cut through the cover, extend in radial directions. The slits form a plurality of flexible, pie-shaped segments which coact with the opening to readily adapt to receiving various size handles of the paint brush or roller. A unique, flexible seal is tightly wrapped in conical relation around the handle in covering relation with the opening and surrounding segments to seal the chamber and provide a support for the handle to maintain the paint brush or roller in a desired position within the chamber where the bristles of the paint brush and the roller of the paint roller are held in spaced relation from the bottom of the container free of any paint sludge which might settle on the bottom of the chamber. The seal, like the cover, is removably mounted on the container.

10 Claims, 6 Drawing Figures

STORAGE CONTAINER FOR PAINT APPLICATORS

BACKGROUND OF THE INVENTION

The invention relates to wet storage devices for paint applicators, especially paint brushes and rollers which are used in painting the interiors and exteriors of buildings. Wet storage means the temporary storage of such paint applicators in a sealed container either immersed in a paint dissolving solvent or in an atmosphere of vapors of such solvent which may be turpentine or any other suitable paint thinner.

It is desirable to thoroughly clean a paint brush or roller every time it is used. However, this is time consuming and not always practical, especially if the painting project involves several days work. In such cases, it is much easier to simply store the paint brush or roller in a paint dissolving solvent which keeps the paint bristles and roller soft and pliable and ready for use. Most often, a paint brush is placed in a metal can which is partially filled with a paint thinning liquid. The paint in the brush normally settles to the bottom of the can and forms a sludge which impregnates and hardens on the brush, if the brush is stored for a lengthy period of time. The bristles become curved and distorted and harden in this position, making it impossible to use the brush again. Thus, it can be appreciated that the container in which the paint brush or roller is stored, is crucial to the continued life of the paint applicator.

U.S. Pat. Nos. 1,050,318, 1,110,533 and 3,955,670 are typical of the many patents which disclose a storage device that utilizes some type of metal clip for engaging the brush handle to suspend the paint brush in spaced relation from the bottom of a container which is partially filled with a solvent which keeps the paint bristles soft and pliable. U.S. Pat. Nos. 2,141,531 and 2,262,735 disclose typical storage devices which rely on some type of elastomeric seal for engaging the brush handle to support the paint brush in a container which is also filled with some liquid solvent. The invention is an improvement in such devices in that the container of the invention is much simpler and, therefore, more economical to produce and sell. Further, the seal used to engage and support the paint brush or roller is a wraparound-type seal which can be tightened, by hand, around the brush handle to insure that the brush handle will not slip through the seal into the container. The invention, contrary to the prior art indicated above, is readily adapted for use with paint rollers in addition to paint brushes.

SUMMARY OF INVENTION

Briefly stated, the invention is in a wet storage device which is primarily used to temporarily store a paint brush or roller. The device essentially comprises, (I) a hollow container for holding a paint cleaning solvent, (II) a cover for sealing the open top of the container, the cover having at least one small opening with radially oriented slits cut through the cover, the slits forming between them a plurality of flexible, pie-shaped segments for frictionally engaging and holding the brush or roller handle, and (III) a flexible seal which is tightly, conically wrapped around the brush handle in covering and sealing relation with the opening and slits to support the paint brush or roller in a desired position within the container where the paint bristles or roller are in spaced relation from the bottom of the container.

BRIEF DESCRIPTION OF THE DRAWING

The following description of the invention will be better understood by having reference to the accompanying drawing, wherein.

DESCRIPTION OF INVENTION

Figure 1:
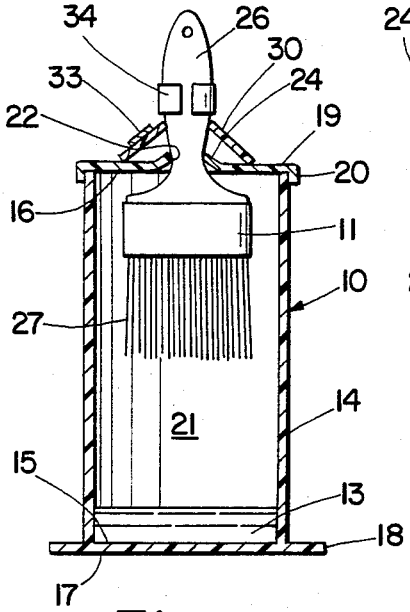
FIG. 1 is a cross-section of a brush storage device which is made in accordance with the invention.
Figure 3:
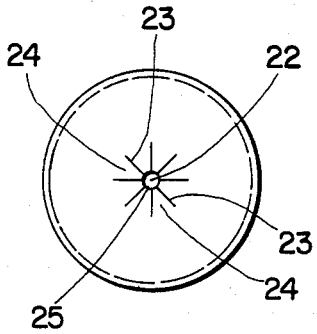
FIG. 3 is a plan view of a cover of the device, illustrating the opening with the special pie-shaped segments that surround the opening.
Figure 4:
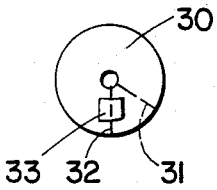
FIG. 4 is a plan view of the frusto-conically shaped seal that is used in combination with the cover to hold the paint brush or roller firmly, in position.
Figure 2:
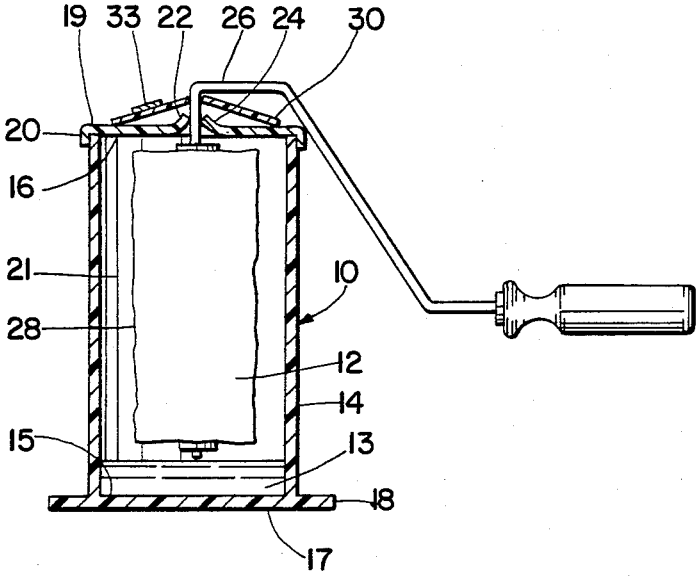
FIG. 2 is a similar cross-section, but of a paint roller storage device which is made in accordance with the invention.

With general reference to the drawing for like parts and particular reference to FIGS. 1–4, there is shown a device 10 which is used in the temporary, wet storage of a paint applicator, such as a paint brush 11 or paint roller 12 shown, respectively, in FIGS. 1 and 2. In this case, the brush and roller are placed in an atmosphere of vapor or fumes given off by the paint cleaning solvent 13 which is stored within the device 10.

The storage device 10, when in a vertical position, comprises a hollow, vertically elongated container 14 which may be any suitable shape, e.g. cylindrical as shown, for holding the solvent 13. The hollow cylindrical container 14 is composed of any appropriate material, such as solvent resistant plastic, and has a closed bottom 15 and an open top 16 which is vertically spaced above the bottom 15 which is formed by an integral, solid circular base 17 which has a laterally outstanding annular flange 18 which has an outer diameter that is substantially greater than the outside diameter of the container 14 to stabilize the container and prevent it from tipping over and spilling the solvent 13.

A solid, planar lid or cover 19 with a downwardly directed annular flange 20 for frictionally engaging the adjacent sides of the container 14, is detachably mounted on the open top 16 of the container to seal the solvent holding chamber 21, formed in the container, from the ambient atmosphere. The cover 19 is, likewise, composed of plastic and has at least one small opening 22 (FIG. 3) from which a number of similar slits 23, cut through the cover, extend in radial directions to form between them, a plurality of similar, pie-shaped, flexible segments or tabs 24 which, in effect, are integrally hinged to the cover 19, so that the arcuately-shaped free ends 25 of the segments 24, can be deflected downwardly or upwardly, as shown, out of the plane of the cover 19. The flexible segments 24 converge upwardly above the plane of the cover 19 to frictionally engage and help hold the handle 26 of the paint brush 11 and roller 12 within the chamber 21, so that the paint bristles 27 of the paint brush 11 and the roller 28 of the paint roller 12 are spaced from, and free of, the bottom of the container 14 which is important, since paint, which contaminates the solvent, settles to the bottom and forms a sludge which can adversely impregnate and harden on the bristles 27 or roller 28 to make these particular paint applicators unsuitable for further use.

A flexible seal 30 which is composed of any suitable material, e.g. plastic such as polyvinyl chloride, is tightly wrapped in conical relation around the handle 26 of the paint brush 11 or roller 12 to cover and seal the opening 22 and slits 23 and compressively engage the handle to reinforce holding the paint brush or roller in a desired position within the container 14. In fact, the seal 30 is the main support for the paint applicator. The seal is an arcuately-shaped segment which has a pair of opposing ends 31,32 (FIG. 4) which are detachably joined together in overlapped relation by an suitable means, e.g. Velcro brand fastener 33, when the seal is positioned around the handle 26. The positioned seal 30 is frusto-conically shaped with sides that converge upwardly away from the cover 19. The seal 30, as seen in FIG. 2, is designed to engage the handle of the paint roller 12 just below a 90° bend in the handle to provide adequate support for the roller 28 in the container 14.

In the case of the paint brush 11, a flexible, generally C-shaped clamp or clasp 34 is placed partially around the paint brush handle 26 just above the seal 30 and acts as an abutment which is carried by the brush handle 26 for engagement with the seal to further insure that the brush handle 26 won't slip into the container 14. A short length of slit, polyvinyl chloride tubing was found to have excellent gripping characteristics for use as a clasp 34.

Figure 5:
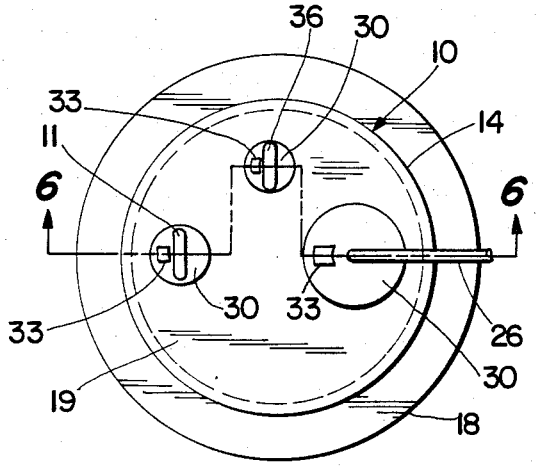
FIG. 5 is a plan view of another embodiment of the invention, designed to store several paint applictors.
Figure 6:
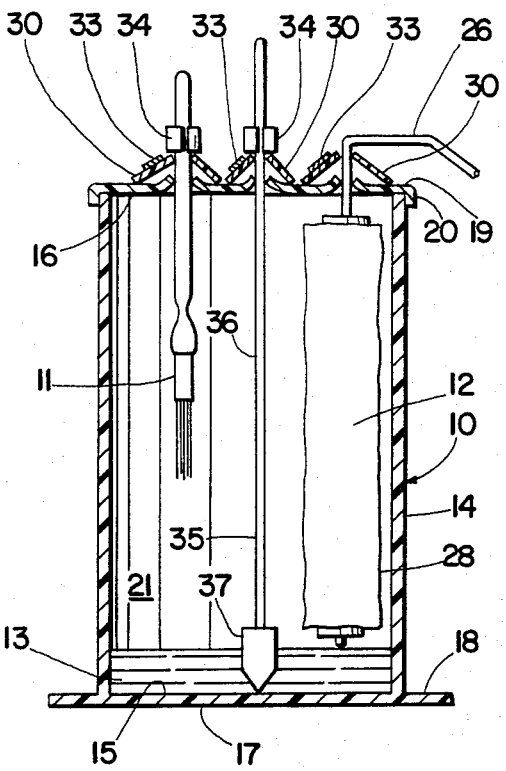
FIG. 6 is a section viewed from the line 6—6 of FIG. 5, showing the paint applicators and a dauber for wetting the applicators periodically with liquid solvent.

It can be appreciated from a study of the drawing that the wet storage device 10 can be built to accommodate one or a plurality of paint brushes, either alone or in combination with a paint roller. This is precisely the embodiment of FIGS. 5 and 6 which illustrate the wet storage of a paint brush 11, a paint roller 12, and a dauber 35 which is used to periodically wet the bristles 27 of the paint brush 11 and the roller 28 of the paint roller 12 to keep them soft and pliable in cases where the applicators are stored for extended periods of time.

The dauber 35 comprises a long handle 36 with an attached sponge-like, solvent absorbent head 37 which is used to contact and wet the bristles 27 and roller 28. The above-described opening, seal and clasp assembly can be used to hold the dauber 35 in place within the container 14. A larger opening with any suitable cap assembly can be used to greater advantage, since the larger opening will allow greater maneuverability of the dauber 35 within the container 14.

Thus, there has been described a novel wet storage device in which relatively unclean paint brushes and rollers, i.e. not thoroughly cleaned brushes and rollers free from paint, can be temporarily stored until they can be properly cleaned or reused in further painting. The device is simple, in design, and not readily susceptible to wear because of the unique, pliable seal which is wrapped around the handle to seal the container and provide support for the paint brush or roller within the container in spaced relation above the bottom of the container. The unique opening in combination with the surrounding flexible segments or tabs makes the device readily adaptable to a number of different size paint brushes or rollers, contrary to prior art devices which utilize openings which accommodate a limited number of different size brushes, much less any paint rollers.

What is claimed is:

1. A device for holding a paint applicator, such as a paint brush or paint roller, which has a handle for holding, comprising:

(a) a container for holding liquid, such as paint thinner, the container having a closed bottom and sides which define a liquid holding chamber, the container having an open top in vertical spaced relation above the bottom, when the container is vertically disposed;

(b) a cover sealing the open top of the container, the cover having at least one small opening from which a number of slits, cut through the cover, extend in radial directions to form therebetween, a plurality of pie-shaped segments which are flexible and deflectable upwardly and downwardly out of the plane of the cover, the opening and surrounding flexible segments designed to receive the handle of the paint applicator, the handle extending through the opening exteriorly of the container and held therein such that the vertically lowermost portion of the applicator is maintained in spaced relation above the bottom of the container;

(c) means for detachably mounting the cover on the open top of the container; and (d) a reusable, flexible steel, separate from the cover, for conically wrapping around the handle protruding from the container and opening, when the applicator is properly positioned in the container, the seal including (i) a specially shaped piece of elastomeric material which has a pair of opposing ends that are overlapped when the seal is conically wrapped around the handle, and (ii) means carried by each of the opposing ends of the material for repeated, detachable interlocking engagement when the ends of the material are overlapped, to hold the seal in tightly wrapped relation around the handle, the seal designed to rest in supported relation on the cover and to compressively engage the handle and cover the opening and radially oriented slits to seal the chamber from the ambient atmosphere and hold the handle to prevent it from slipping into the chamber of the container, the conical wrapping of the seal designed to form a sturdy support with, in effect, a variable size opening in which differently sized handles can be compressively engaged and supported.

2. The device of claim 1, wherein the container is vertically elongated and sufficiently sized to hold a paint applicator of the group consisting of paint brushes and paint rollers when the roller of the paint roller is vertically disposed.

3. The device of claim 2, wherein the cover includes a plurality of openings, each of which has a set of radially oriented slits.

4. The device of claim 3, wherein the container is cylindrical, in shape, and includes an annular flange which surrounds the container adjacent the bottom thereof and stabilizes the container to prevent it from tipping over.

5. The device of claim 4, which includes a flexible clasp for placement on the handle to grip the handle just above the seal and abut the seal to help prevent the handle from slipping into the chamber.

6. A device for holding a paint applicator, such as a paint brush or paint roller, in an atmosphere of a paint dissolving solvent, comprising:

(a) a vertically elongated hollow cylindrical container which has a chamber for holding liquid, such as a paint dissolving solvent, the chamber defined by the cylindrical sidewalls of the container and the solid, closed bottom of the container, the closed bottom including an annular flange which surrounds the container adjacent the bottom and which has a sufficiently large diameter to stabilize the container and prevent it from tipping over, the container having an open top through which liquid is poured into the chamber when the container is vertically disposed;

(b) a solid, planar elastomeric cover detachably mounted on the open top of the container to seal the chamber from the ambient atmosphere, the cover having a downwardly extending annular flange which frictionally engages the adjacent cylindrical sidewalls of the container, the cover including at least one rather small opening which has a number of slits, cut through the cover, which extend in radial directions from the opening and form between them, a plurality of pie-shaped segments which surround the opening, the segments having free ends which are arcuately shaped and define the opening, the free ends of the segments being deflectable out of the plane of the cover, the segments converging in a direction above the cover to compressively engage the handle of, for example, a paint brush, when the handle is inserted through the opening upwardly from the side of the cover closest the bottom of the container; and (c) a flexible reusable seal, separate from the cover, removably wrapped in conical relation around the handle of a paint applicator when the handle extends upwardly through the opening and the remaining portion of the applicator is in the chamber, the seal, when positioned around the handle, being frusto-conically shaped and having a pair of opposite ends in overlapped relation, the overlapped ends each carrying means for repeatedly detachably joining the ends together in overlapped relation, and the seal being sufficiently sized to cover the opening and surrounding segments to seal the chamber from the ambient atmosphere, the seal resting in supported relation on the cover, and the conical wrapping of the seal being designed to form a sturdy support with, in effect, a variable size opening in which differently sized handles can be compressively engaged and supported.

7. The device of claim 6, which includes a plurality of openings, each of which has surrounding pie-shaped segments, one of the openings being sized to accommodate a paint brush and one of the openings sized to accommodate a paint roller.

8. The device of claim 7, which includes, (i) a partic-ylindrical clasp positionable on the handle of a paint brush just above the seal to abut the seal and coact with the seal to prevent the handle from slipping into the chamber, and (ii) a dauber positionable in the chamber through an opening in the cover, the dauber having a liquid absorbent head for transferring liquid to bristles of the paint brush and the roller of the paint roller.

9. The device of claim 8, wherein the seal and clamp are plastic being composed of polyvinyl chloride, and the head of the dauber is composed of sponge like material, and the container and cover are composed of plastic.

10. The device of claim 9, wherein the means for detachably mounting the overlapped ends of the seal together includes a Velcro brand fastener secured to the ends.

* * * * *